United States Patent [19]

Pilz, III

[11] 4,065,048

[45] Dec. 27, 1977

[54] SELF-LOCKING FLANGED CAP

[75] Inventor: William M. Pilz, III, Eldridge, Iowa

[73] Assignee: Container Corporation of America, Chicago, Ill.

[21] Appl. No.: 727,717

[22] Filed: Sept. 29, 1976

[51] Int. Cl.[2] ..... B65D 5/64; B65D 43/08

[52] U.S. Cl. ..... 229/43; 229/35

[58] Field of Search ..... 229/32, 35, 43, 23 R, 229/23 T

[56] References Cited

U.S. PATENT DOCUMENTS

| | | | |
|---|---|---|---|
| 1,926,941 | 9/1933 | Gomes | 229/23 R |
| 2,393,994 | 2/1946 | Kuhlman | 229/38 |
| 2,445,034 | 7/1948 | Moore | 229/35 X |
| 2,768,778 | 10/1956 | Ferguson et al. | 229/35 |
| 2,844,294 | 7/1958 | Williams | 229/6 A |
| 3,093,291 | 6/1963 | Brandle | 229/35 |
| 3,203,619 | 8/1965 | Wilson | 229/43 |

*Primary Examiner*—Davis T. Moorhead

*Attorney, Agent, or Firm*—Carpenter & Ostis

[57] ABSTRACT

A self-locking cap for a tubular container having downwardly extending flanges at the upper end thereof, which cap includes a plurality of flanges adapted to receive the flanges of the container and having retaining means for maintaining the flanges of the cap and container in interlocking relationship.

2 Claims, 4 Drawing Figures

SELF-LOCKING FLANGED CAP

SUMMARY OF THE INVENTION

The invention relates to a closure arrangement for a tube and cap style container of the type commonly used in the major appliance industry.

Normally, caps of this type are secured to flanged tubes by means of steel straps or wire banding. It is necessary on semi-automatic setups, to similarly hold the corners of the cap in place until the straps are secured. This has been difficult in the past and various types of integral locking arrangements have been unsuccessful to date.

It is, therefore, an object of this invention to provide for a tube style container and interlocking cap arrangement containing integral means to maintain the cap and container flanges in interlocking relationship with each other.

A more specific object of the invention is to provide a cap having depending flanges, each of which includes an outer and inner panel adapted to receive a related flange of a container, and a retaining flap with a lock tab adapted to hold the flanges together.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

DESCRIPTION OF THE INVENTION

Figure 1:
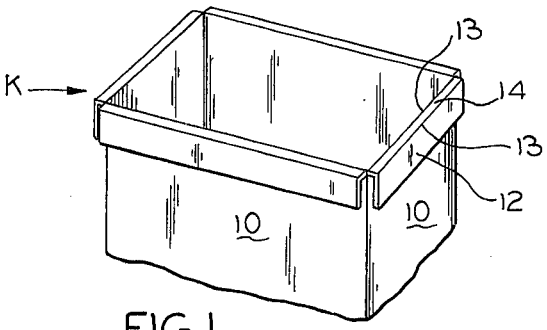
FIG. 1 is a fragmentary, perspective view of a tube style container having flanges at at least one end thereof.

Referring now to the drawings, it will be seen that a conventional tube style container indicated generally at K, is shown in FIG. 1. This container is adapted to be closed by an interlocking cap indicated generally at C, which is illustrated in FIG. 2, and which may be formed from a unitary blank indicated generally at B, of foldable sheet material, as illustrated in FIG. 4.

Referring to FIG. 1, it will be seen that container K is a conventional tube style container having a plurality of vertical side walls 10, each of which has a retaining flange 12, foldably joined to its upper edge along a pair of spaced fold lines 13, which define a relatively narrow hinge strap 14 therebetween.

Figure 4:
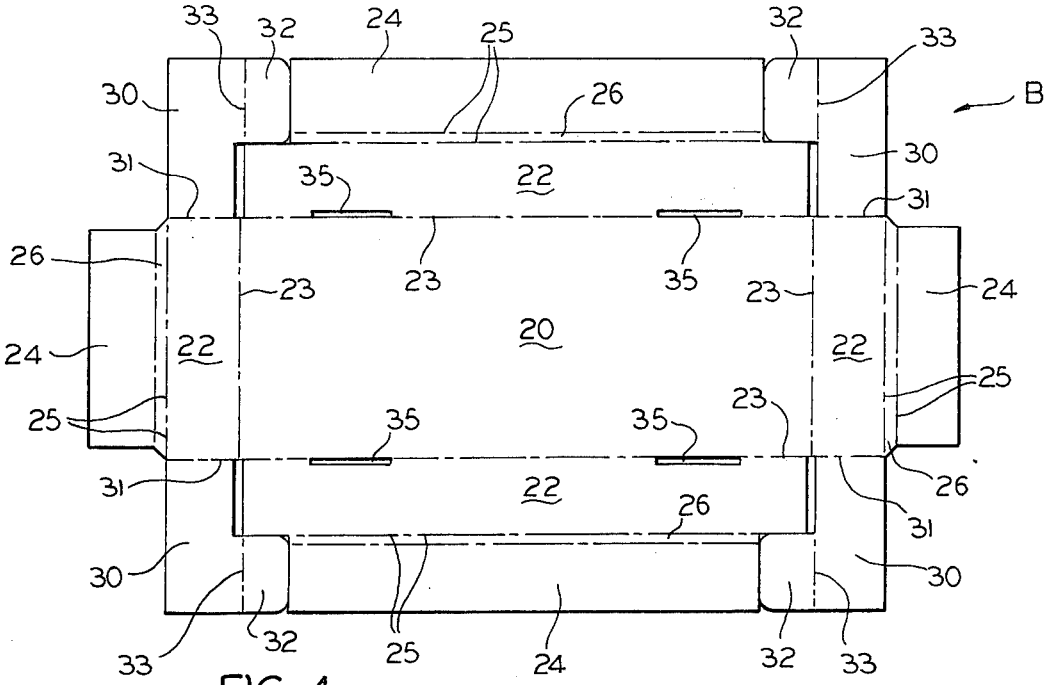
FIG. 4 is a plan view of a blank from which the cap illustrated in FIG. 2 may be formed.
Figure 2:
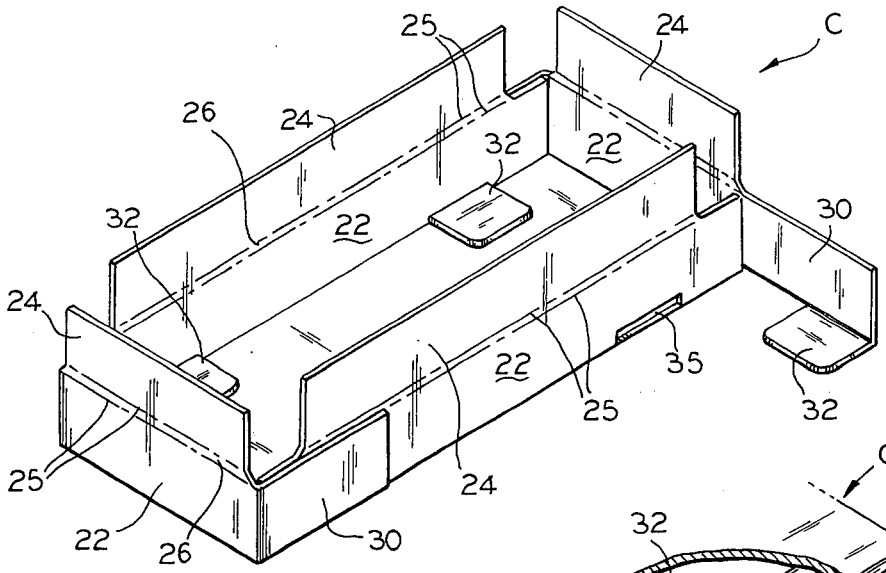
FIG. 2 is a perspective view, shown in the inverted position, of a self locking cap embodying features of the invention.

Referring now to FIGS. 2 and 4, it will be seen that the cap includes a preferably rectangular, generally flat, top wall 20; although in the embodiment illustrated in the drawings, the cap and container are shown as being rectangular, it is to be understood that the same principles of the invention would apply to a six or eight sided container, as well as a rectangular container. The cap is provided with a plurality of depending flanges, each of which includes an outer panel 22, foldably joined to a related side edge or top wall 20 along a fold line 23 and disposed to extend downwardly therefrom, and an inner panel 24 foldably joined to the lower edge of outer panel 22 along a pair of spaced fold lines 25 which define a relatively narrow hinge strip 26 therebetween.

Figure 3:
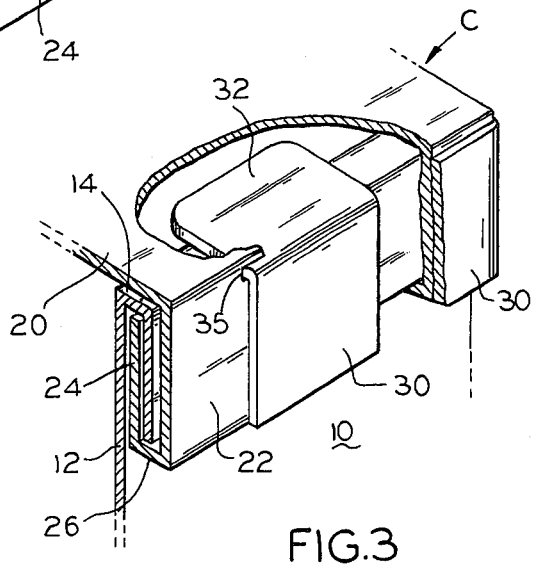
FIG. 3 is a fragmentary, perspective view, illustrating the interlocking relationship of the cap and container when in the erected condition.

As best seen in FIG. 3, when in the erected condition, the inner and outer panels of each cap flange provide a pocket open at the top for receiving a downwardly extending flange 12 of the container.

In order to maintain the cap and container flanges in interlocking relationship either permanently or until such time as a steel band is applied thereagainst, there are provided a plurality of retaining flaps 30 which are each foldably joined at one end on fold line 31 to a related side edge of a cap flange outer panel 22 and which, as best seen in FIG. 3, are folded to lie against the outer surface of the outer panel 22 of an adjacent cap flange. At the opposite end of each retaining flap 30, there is foldably joined to an upper edge thereof, along fold line 33, a lock tab 32 which is folded at right angles to the retaining flap 30 and received within a related aperture 35 which is located in the adjacent flange outer panel and the top wall of the cap. This is best illustrated in FIG. 3.

Thus it will be seen that the invention provides a relatively simple and economical cap arrangement formed from a unitary blank of paperboard which provides an integral retaining means for holding the cap and container flanges in interlocking relationship.

I claim:

1. In a self-locking cap, for a tubular container having opposed pairs of side and end walls with integral flanges extending outwardly and downwardly from the upper edges thereof, the combination of:

a. a generally rectangular top wall having opposed pairs of first and second flanges depending therefrom to form a box-like structure open at the bottom for receiving the upper end of an open top container;

b. each of said flanges including an outer panel, foldably joined at its upper edge to a side edge of said top wall and extending downwardly therefrom, and an inner panel, foldably joined to a lower edge of said outer panel and extending upwardly therefrom on the inside thereof, which form a pocket for receiving a downwardly extending flange of said container;

c. integral retaining means for maintaining said cap and container flanges in interlocking relationship;

d. said retaining means including:

i. opposed pairs of retaining flaps each foldably joined at one end edge to a related side edge of a first flange outer panel and folded to overlie an adjacent second flange outer panel;

ii. a lock tab foldably joined to an upper edge of each retaining flap adjacent the other end thereof and receivable with a related aperture in said second flange, which aperture is located adjacent the juncture of said top wall and said second flange outer panel.

2. In a self-locking cap, for a tubular container having a plurality of side walls with integral flanges extending outwardly and downwardly from the upper edges thereof, the combination of:

a. top wall having a plurality of flanges depending therefrom to form a box-like structure open at the bottom for receiving the upper end of an open top container;

b. each of said flanges including an outer panel, foldably joined at its upper edge to a side edge of said top wall and extending downwardly therefrom, and an inner panel, foldably joined to a lower edge of said outer panel and extending upwardly therefrom on the inside thereof, which form a pocket for receiving a downwardly extending flange of said container;

c. integral retaining means for maintaining said cap and container flanges in interlocking relationship;

d. said retaining means including:

i. retaining flaps each foldably joined at one end edge to a related side edge of one flange outer panel and folded to overlie an outer panel of an adjacent flange;

ii. a lock tab foldably joined to an upper edge of each retaining flap adjacent the other end thereof and receivable with a related aperture in said other flange, which aperture is located adjacent the juncture of said top wall and said adjacent flange outer panel.

* * * * *